United States Patent [19]

Watts

[11] Patent Number: 4,546,417

[45] Date of Patent: Oct. 8, 1985

[54] SELF-LUMINOUS LIGHT SOURCE

[75] Inventor: David J. Watts, Benton, Pa.

[73] Assignee: Safety Light Corporation, Bloomsburg, Pa.

[21] Appl. No.: 515,067

[22] Filed: Jul. 19, 1983

[51] Int. Cl.[4] ..... F21V 9/16

[52] U.S. Cl. ..... 362/84; 362/399; 362/431; 362/390; 362/311; 313/54

[58] Field of Search ..... 362/84, 34, 159, 266, 362/223, 224, 390, 356, 318, 311, 375, 431, 399; 313/54

[56] References Cited

U.S. PATENT DOCUMENTS

| | | | |
|---|---|---|---|
| 2,080,919 | 5/1937 | Ihlan et al. | 176/122 |
| 2,456,179 | 12/1948 | Finer | 362/431 |
| 2,953,684 | 9/1960 | MacHutchin et al. | 362/84 |
| 3,005,102 | 10/1961 | MacHutchin et al. | 250/77 |
| 3,038,271 | 6/1962 | MacHutchin et al. | 40/130 |
| 3,176,132 | 3/1965 | Muller | 250/71 |
| 3,358,167 | 12/1967 | Shanks | 313/25 |
| 3,368,287 | 2/1968 | Ault | 33/348 |
| 3,566,125 | 2/1971 | Linhart, Jr. et al. | 250/106 |
| 3,578,972 | 5/1971 | Dooley et al. | 250/77 |
| 4,383,382 | 5/1983 | Hegarty | 40/545 |

FOREIGN PATENT DOCUMENTS 1011235 11/1965 United Kingdom .

*Primary Examiner*—Stephen C. Bentley
*Assistant Examiner*—John S. Maples
*Attorney, Agent, or Firm*—Steele, Gould & Fried

[57] ABSTRACT

A self-luminous light source is disclosed having a light-permeable shell, a body disposed within the shell, defining a space between the shell and body, a member connecting the shell and body, radioactive gas disposed in the space, and a phosphor coating on at least one surface of the shell and body. The shell and body may be coaxial glass tubes defining an annular space of restricted width, connected to one another by annular end members.

8 Claims, 6 Drawing Figures

SELF-LUMINOUS LIGHT SOURCE

BACKGROUND OF THE INVENTION

1. Field of the Invention

This invention relates to the field of self luminous light sources employing radioactive gas to activate phosphors deposited on surfaces of the light source, and in particular, to an elongated tubular light source charged with radioactive tritium.

2. Description of the Prior Art

Use of a radioactive gas and a phosphor coating responsive to the emissions of the gas, is known in the art. Such light sources generally take the form of simple glass tubes enclosing the radioactive gas in a cylindrical space. In connection with self-luminous light sources for watch dials and the like, rectangular or other enclosing shapes are employed. In any event, the conventional teachings of the art are to take a simple, sealed glass body having a phosphor coating on the internal surfaces thereof, and to charge the body with the radioactive gas. Particle emissions incident to radioactive decay of the gas within the body activate the phosphors on the inner surface of the external shell, producing light emissions by the phosphors.

Competing concerns such as safety on the one hand, and maximizing brightness and efficiency of the light source on the other hand, require the designer to make a number of choices in the configuration of a light source. A larger enclosed volume results in a larger active surface area, producing increased light. In order to further increase brightness, it has sometimes been found necessary to employ a radioactive gas of a type in which particles released during radioactive decay are emitted at relatively high energy, for example, krypton-85 ($_{36}Kr^{85}$). Gas of this variety will cause photon emissions in phosphors at a distance on the range of tens of centimeters from the decaying atoms, however, such relatively-powerful emissions are not healthful for humans.

Safer levels of particle emission energy are obtained with use of tritium ($_1H^3$) as the radioactive gas. Particles emitted by decaying tritium will activate phosphors within a range of millimeters from the decaying atoms. Accordingly, tritium is a preferred source of phosphor-activating emissions in light sources intended for use in proximity with persons. Unfortunately, such low energy particle emissions are also only able to produce a relatively weak level of light emission in the phosphors.

Production of any radioactive gas is a relatively expensive procedure. It is sometimes the case that the expense of mechanical construction, packaging and the like is small relative to the cost of radioactive gas used in self-luminous light sources. Use of a larger volume of gas and the resulting additional phosphor surface area will, up to a point, proportionately increase the total brightness of the light source. There is a limit, however, to gains in brightness per unit of radioactive gas achievable from using increased amounts of radioactive gas.

As the gas space becomes larger, more of the emitted particles are absorbed by neighboring atoms in the gas, and never reach the phosphor coating to produce light. With respect to tritium, for example, a glass tube having a phosphor coating on its inner surfaces and a diameter greater than several millimeters, i.e., the transmission range of tritium, will be of lower total brightness per unit of tritium (i.e., a lower efficiency) than a group of tubes each having a diameter within the transmission range and enclosing the same total amount of gas. In other words, with the single large diameter tube, emitted particles which happen to be directed radially inward are unlikely to ever reach the phosphors on the far side of the tube. These particles will be absorbed in the gas itself, and will not help produce light.

The relatively low energy of tritium emissions frequently makes tritium unattractive as a phosphor-activating element in a large light source. The low power emission capabilities of tritium means that increasing the diameter of the light source tube in order to increase surface area in fact makes an inefficient use of the tritium. In this respect efficiency is the total light emitted per unit of tritium.

U.S. Pat. No. 3,038,271—MacHutchin et al teaches a self-luminous sign in which a plurality of glass tubes of relatively small diameter are used to activate phosphor coatings over the area of the sign. If the diameter of each of the tubes is kept small, namely within the transmission range of tritium, the disclosed sign can be expected to be relatively efficient in production of light, that is, achieving a reasonable total brightness per unit of tritium, and therefore per unit of cost. Use of a plurality of separate closed glass tubes causes other problems, such as difficulty in production, handling, mounting and the like.

U.S. Pat. No. 3,566,125—Linhart, Jr., et al teaches a light source having a particular contour for the gas-holding space. Light emission is said to be improved by a parabolic facing surface on the phosphor-bearing body, which is enclosed within the light source. It is believed that the increase in luminosity of the Linhart device is due to the increase in phosphor-bearing surface area of a curved area over a flatter one. Linhart's respective embodiments include a number of arrangements in which the transmission range of radioactive emission is clearly exceeded, particularly as to emissions directed toward the rear of the parabolic surface of the phosphor-mounting body.

In the embodiment of FIG. 6, Linhart uses a collimating lens having a convex rear surface. The convex lens has a contour at least partly complementing the parabolic, phosphor-coated surface. Such restriction on the depth of the gas-enclosing space should be a relatively efficient use of radioactive gas. The construction has a number of drawbacks. The efficiency is achieved at expense of a need for multiple parts of dissimilar materials, and the need to connect the parts in a seal which will be impermeable to tritium. Tritium is, of course, a form of hydrogen, which is prone to difficulties with leakage and will diffuse directly through many materials.

U.S. Pat. No. 3,005,102—MacHutchin et al teaches simple gas-enclosing phosphor-coated tubes, but also discloses one embodiment in which a flashlight bulb is simulated using a gas-enclosing plenum of relatively-restricted depth. Reference may be made to MacHutchin's FIG. 3, in which the gas-charged plenum is laid over a hollow glass bulb, with expected increase in efficiency. MacHutchin U.S. Pat. No. 3,005,102, like Linhart Jr., appears to teach an arrangement restricting the depth of the gas space to a distance approaching the transmission range of the radioactive gas. Both patents, however, teach a plurality of dissimilar parts in complex constructions. The constructions, using complex geometrical shapes, and requiring gas-tight junctions, will certainly be difficult and expensive to manufacture.

Increased manufacturing expenses may increase the product cost to an extent that safety and gas conservation gains are outweighed. Moreover, a number of usual junction-making materials are simply not feasible due to diffusion and loss of radioactive tritium through the seals.

U.S. Pat. No. 3,176,132—Muller teaches a refinement of the usual glass tube. A central tube, holding a souce of radioactive emissions, is mounted within a casing tube, and a plurality of coaxial phosphor-bearing tubes, or a spirally wound sheet of phosphor-bearing material, is disposed between the central axial radioactive tube and the casing. This construction is said to be useful to confine the radioactive emissions. While emissions may be confined, such a construction merely aggravates the difficulty with the low transmission range of tritium. Not only will the transmission range be possibly exceeded between the central source of radioactive emissions and the peripheral phosphors, but intermediate layers of phosphor-bearing material, phosphors and gas will themselves absorb emissions. Moreover, photon emissions from the excited inner phosphors must pass through multiple surrounding layers to reach the casing, in order to be released from the lamp as useful light. Accordingly, although Muller teaches a structure including coaxial tubes, the teachings emphasize safety over efficiency, and are more appropriate for high energy particle emitting gases and the like.

The present invention employs a central body and an external casing, the body and casing together defining a gas-enclosing space of restricted width around the device. The inward-facing walls of the enclosed space are preferably all coated with phosphors. The invention therefore conserves gas by not exceeding the transmission range of the gas, for example tritium. Inasmuch as the device is preferably formed by a pair of coaxial glass tubes, sealed to form an annular glass-bounded area, an integral glass body results in which no possibility of leakage or diffusion loss is presented.

Apart from radioactive self-luminous devices, in connection with electric discharge devices and chemically-operated self-luminous lamps, a number of coaxial tube constructions are known. In electric discharge devices, outer tubes are structured and intended as optical filters or for mechanical protection, and are not arranged to form a confined space for a radioactive gas. On the contrary, the operative gas and the electric discharge elements are almost invariably mounted in the central axial space. There is therefore no particular requirement of a complete enclosure around the inner tube. In addition, there is no difficulty with any safety consequences of radioactive emissions and no need for spacing of elements because the most dangerous emission expected from the light source (and the most often blocked via a shield) is ultraviolet radiation.

U.S. Pat. No. 3,358,167—Shanks teaches a jacketed electric discharge lamp in which an outer casing physically protects the operative electric discharge light source mounted along the axis. A resilient plug having a central circular opening for receiving the light source, and an annular groove for receiving the casing is disclosed.

U.S. Pat. No. 2,080,919—Ihln et al teaches a spring-like form of resilient spacer in an electric discharge device. The space between the light source and the casing is evacuated, to decrease heat loss by conduction/convection.

A third category of interest is light sources powered by chemical reaction. Unlike either electric discharge devices or radioactive light sources, chemically self-luminous devices employ sealed containers of reagents within an external casing. The containers frequently are tubular, and means are provided to break or otherwise open the containers and thereby mix the reagents. These devices seldom have any direct connection between inner and outer tubes.

The present invention involves a coaxial tube arrangement particularly adapted for self-luminous radioactive light sources. An optimum width gas enclosure is produced by a relatively inexpensive and easy to manufacture construction. The light source as so constructed can be further mounted in a casing with resilent shock-absorbing means and/or provided with a mounting as desired for a given use.

SUMMARY OF THE INVENTION

It is an object of the invention to optimally increase the active surface area of a radioactive light source in order to achieve a high total brightness per unit of radioactive material.

It is an object of the invention to conserve radioactive gas and thereby minimize the expense of radioactive self-luminous light sources.

It is a further object of the invention to achieve high total brightness without degrading safety of a radioactive light source.

It is another object of the invention to produce a bright, inexpensive and long lasting light source which is easy to manufacture, safe and convenient.

These and other objects are accomplished by a self-luminous light source comprising a light-permeable shell, a body disposed within the shell, a space being bounded by facing surfaces of the shell and the body, at least one member spacing the shell and the body, and holding the shell and body with respect to one another around the space, a radioactive gas disposed in the space, and, a phosphor coating on at least one of the surfaces of the shell and/or body, the phosphor coating emitting light in response to exposure to emissions of the radioactive gas. The light source preferably comprises coaxial gas tubes defining an axial space within the inner glass tube, the axial space being left open, and an annular space between the tubes, sealed at the ends by glass members, for enclosing the radioactive gas.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein.

DESCRIPTION OF THE PREFERRED EMBODIMENTS

Figure 1:
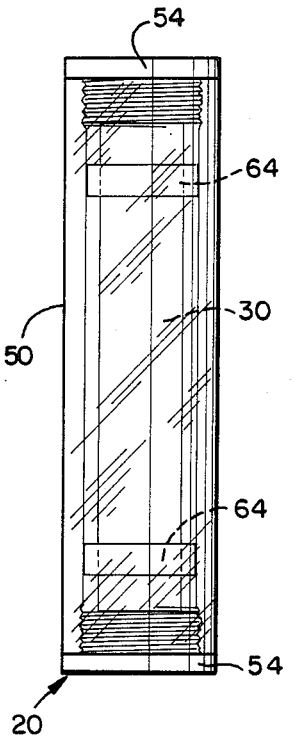
FIG. 1 is an elevation view of the complete assembly according to the invention.
Figure 6:
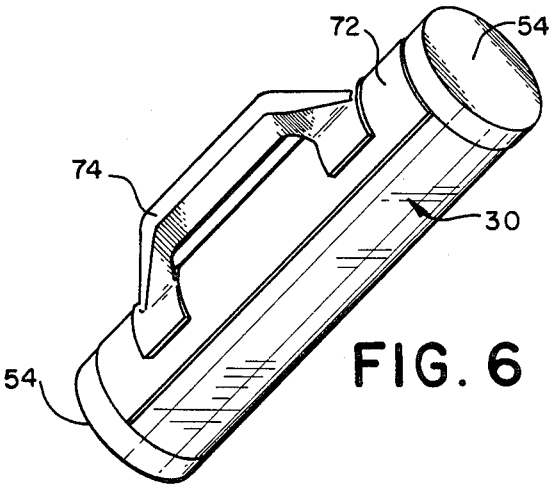

The light source of the invention may be packaged in various ways. It will be appreciated that a static or permanently-mounted installation will require less in the way of shock absorbing means, while mobile or exposed locations may require additional protection, and the like. The invention will be described with reference to a protected but otherwise unmounted light source, or to a hand-held light source, as shown in FIGS. 1 and 6, respectively. It should be appreciated that the invention is applicable to various mounting arrangements, other constructions and uses.

Figure 2:
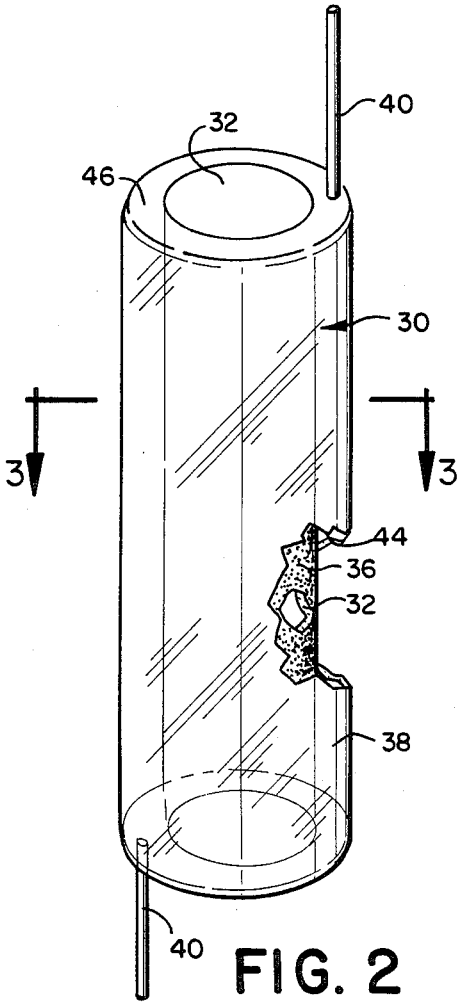
FIG. 2 is a partially broken away perspective view of the self-luminous light source of the invention.
Figure 3:
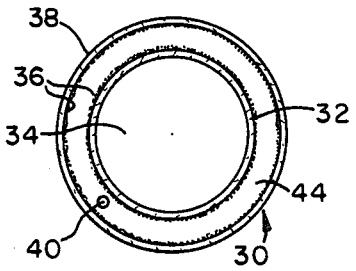
FIG. 3 is a section view taken along lines 3—3 in FIG. 2.

The basic light source of the invention, as shown in FIGS. 2 and 3, preferably comprises a light-permeable glass outer shell 38, enclosing an inner body of slightly smaller diameter, for example, inner tube 32, coaxial with the outer shell. The inner tube need not be a coaxial glass tube, but may be a solid body spaced from shell 38. The shell and/or body may also be of irregular cross-section, or the like. It is presently preferred that coaxial glass tubes, preferably of borosilicate glass or the like, be integrally joined at their ends using annular glass portions of complementary shape.

A radioactive gas such as tritium ($_1H^3$) is disposed in the annular space 44 between the outer shell 38 and the inner body 32. A phosphor coating 36, responsive to the emissions of the tritium or other radioactive gas, is applied to the external surfaces of inner body 32, and/or to the internal surfaces of outer shell 38. Beta particles emitted by the tritium during radioactive decay excite the phosphor which in turn releases photons.

In order to take maximum advantage of light emitted by the excited phosphors, and for ease of construction, it is preferred that inner body 32 be a tubular glass shell of slightly smaller diameter than the external shell 38. The central axial space 34 encompassed by the inner shell is unused and may be left open to the air. Alternatively, the axial space could be used to attach the device to a mounting, for example using an axial dowel. An elongated annular space bearing tritium and bounded by the phosphor-coated transparent bodies, is the primary source of light. Inasmuch as particles emitted by tritium have relatively low energy levels, the relatively narrow width of gas space has the effect that a larger proportion of the total emissions of radioactive decaying gas will strike the phosphors, rather than be absorbed in the neighboring molecules of gas.

In addition to the beneficial effect of bringing the phosphor-bearing surfaces to within the transmission range of the gas, the geometry of the invention has further beneficial consequences. The use of a narrow gas-enclosing space is also a means of increasing the surface area for bearing phosphors. For a given gas volume, the invention provides more phosphor area per unit of enclosed volume than does a simple cylinder. Besides allowing this additional amount of phosphor surface, the invention brings the outer surface of the inner body and its phosphor coating to close proximity to the exterior shell, whereby photon emission from the inner body phosphors is ultimately less attenuated when emitted from the light source. Of course narrowing the annular gas enclosing space also has the effect of reducing the number of particles of radioactive decay which strike the phosphors.

The particular optimum width of the enclosed space which will produce the most light per unit of gas is subject to a number of variations such as the variation in transmission range depending on the type and pressure of the particular gas used. For example, at higher gas pressure, the transmission range will be reduced due to the increased probability that emitted particles will strike neighboring gas molecules. Similarly, the choice of phosphor and thickness of phosphor coating will impact on the particular optimum by altering the light transmission properties of the outer shell.

The optimum dimensions of the overall unit will be likewise dependent upon the transmission range of the particular choice of radioactive gas. Tritium, an emitter of low energy particles, has a transmission range on the order of millimeters, and a tube 30 designed for use of tritium would therefore have an enclosed annular space 44 of that range of width. On the other hand, krypton-85 ($_{36}Kr^{85}$) has a transmission range in the tens of centimeters, and a large light source could thereby be prepared having an annular gap in that range, and a higher luminosity.

Suitable phosphors for radioactive light sources are known in the art. Examples of suitable phosphors are zinc-cadmium-sulfide, zinc sulfide, zinc silicate, cadmium sulfide, and the like. The phosphors may be applied to the inner surfaces in the form of powder, by use of a suitable glue, binder or other vehicle, as also known in the art. The light emission can be directed efficiently outwards by coating the internal surface of the central tube with reflective material such as white paint.

In order to charge the vessel defined by the inner body and outer shell with tritium, capillary seal tubes 40 are provided, for example at either or both ends of the enclosed space. One tube 40 will suffice, depending on the process used. The enclosed space is simply charged with tritium, and a portion of the tube melted, whereupon collapse of the tube or the bead of melted glass thereby formed closes capillary tube 40. This procedure entirely closes the bounded space 44 in glass. Capillary tubes 40 can be melted down as close as convenient to the covered ends 46. Short capillary tubes, of course, are more convenient and less prone to breakage.

The overall assembly may be formed by a number of procedures, as known in the art of glass working. The bodies may be formed by lamp working to join complementary flanged tubes of the needed diameters, with or without use of frit. It may also be desirable to employ tubes having one closed end for either or both tubes 32, 38, the annular space being closed on the other end.

Glass is preferred for use with the invention due to the particular properties of glass, and the radioactive gases employed. Glass is, of course transparent. Glass is also sufficiently dense to confine tritium gas which, as an isotope of hydrogen, would diffuse through many materials. Borosilicate glass is preferably used in a light source with tritium. For krypton-85, it may be necessary to employ a different glass, as known in the art, in order to avoid browning of the glass over time as a result of exposure to radiation.

Unlike electric discharge devices and/or chemically operative self-luminous light sources, radioactive light sources do not generate substantial temperature variation in use. Once the unit is charged, the phosphors are excited and the lamp stays lighted until the phosphors are eventually broken down by the radioactive emissions, or until an unacceptable proportion of the tritium decays into helium 3 ($_1He^3$). The unit should be designed to withstand the usual temperature variations and mechanical shocks expected in the particular environment.

Figure 4:
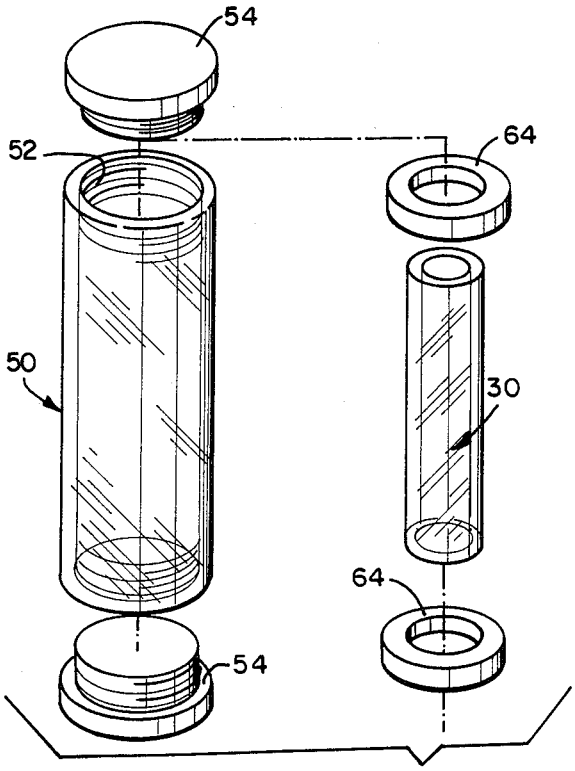
FIG. 4 is an exploded perspective view of the assembly of FIG. 1.

Light source tubes 30 can be used for various applications, including those known in the art. Self-luminous exit signs for buildings and vehicles, highway markers, aircraft markers (both inside and outside) and stationary mobile units may be constructed by employing the tube of the invention in place of conventional light sources or simple hollow cylinders or radioactive, phosphor-coated glass. When used as a mobile or manually-carried light source, additional protective features or means for conveniently manipulating the light source are recommended, for example as shown in FIGS. 1, 4 and 6. FIG. 1 shows a completely-assembled shock-resistant unit. Lamp unit 30 (comprising co-axial tubes) is disposed within yet another outer coaxial member 50. Transparent member 50 is preferably formed of a relatively resilient transparent plastic, or a thick layer of glass, to decrease the possibility of breakage. Plastic may be expected to decrease the incidence of breakage, and also facilitates attachment of additional mounting features. An exploded view of the assembly is shown in FIG. 4.

Transparent external casing 50, for example of plastic, is internally threaded at its ends 52, 52, for receipt of end plugs 54, 54. End plugs 54 are threadably fitted into threaded ends 52 of casing tube 50. One or both of the end caps may be threaded or provided with other attachment means to secure the device to a mount.

Casing 50, and for that matter glass tubes 32, 38, may be transparent, translucent, frosted, colored or otherwise adapted to the needs of a particular situation. The basic color emitted is substantially governed by the choice of phosphor, however, a certain range of modifications are possible. For example, a more attractive light source may be produced by employing a frosted external casing 50, and a brighter or more-focused light may be produced by a completely-transparent casing. A frosted or translucent outer tube and/or external casing will also tend to attractively conceal details of internal construction, for example the existence of shock absorbing discs 64.

The external dimension of tube 30 may be of smaller diameter than the inside of casing 50, or may be nearly the same diameter. In order to minimize the possibility of breakage, a relatively larger space can be allowed between casing 50 and tube 30 and that space filled with a resilient shock-absorbing pad or spacer such as disc 64. With reference to FIGS. 1 and 4, suitable shock-absorbing mounting means 64 may be provided from sponge rubber or the like in the form of a wafer. The spacer is axially cut to fit tightly around tube 30, and externally dimensioned to fit tightly within tube 50. Additional shock-absorbing means (not shown) may be placed between the ends of tube 30 and caps 54. The shock absorbers supply resilience to cushion tube 30 against impact should be unit be dropped or struck against a hard surface.

Figure 5:
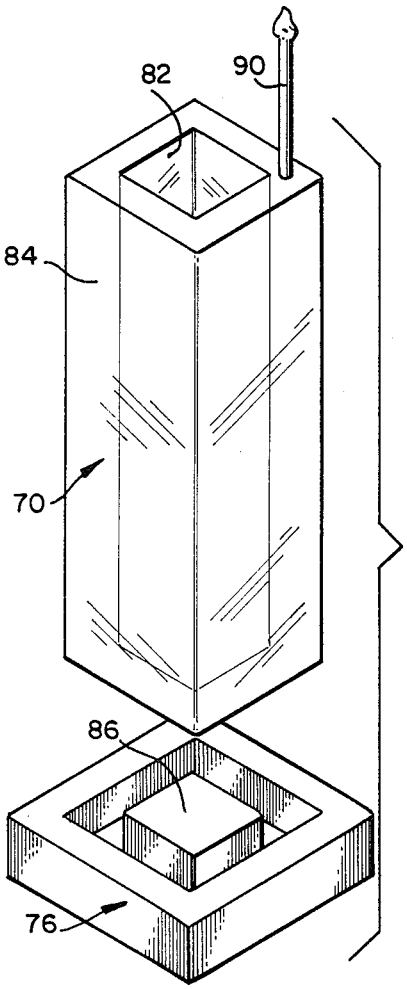
FIG. 5 is a partial exploded perspective view of an alternative embodiment of the invention; and, FIG. 6 is a perspective view of an alternative embodiment of the invention.

With reference to FIG. 5, other possible constructions for the tube and spacer are possible. For example, a tube 70 of rectangular cross section can be formed from a pair of elongated square tubes, 82, 84. Like the embodiment of FIGS. 1–4, only the space between tubes 82, 84 is charged with radioactive gas, and the space is entirely sealed in glass by melting capillary tube 90. This completed glass "lightbulb" can be further packaged as needed.

FIG. 5 also shows an alternative embodiment of a spacer 76. Spacer 76, as above, employs a resilient body, for example of sponge rubber, for surrounding and cushioning tube 70. In addition, a central plug 86 is integrally formed with spacer 76, the plug 86 being inserted into the axial space inside inner tube 82, further connecting spacer 76 and tube 70, and also protecting any extending portion of capillary tube 90. It will be appreciated that inasmuch as internal plug 86 is formed integrally with the spacer, this mounting means may be employed only over the ends of the tube. If desired, one or more additional spacers, lacking the central plug 86, or possibly to be used with separate plugs, may be employed for use at intermediate portions along the length of tube 70. Further mechanical support can be provided, or some protective features omitted, as needed in given uses.

Another possible variation on the invention is shown on FIG. 6. In FIG. 6, a handle 74 is mounted along the side of the light source. In addition, a reflective shield 72 is provided along one side, for example under the handle, allowing the user to direct the emission of light. The reflector can be mounted inside the external casing, and held in its position by the inward pressure of caps 54. Handle 74 can be likewise provided with members engaging end caps 54, or may be simply glued to the casing. If desired, a movable cover can be provided to enclose the device when light emission is not desired.

Further variations on the present invention are possible, and will be apparent in light of this disclosure to persons skilled in the art. Reference should be made to the appended claims rather than the foregoing specification as indicating the true scope of the invention.

I claim:

1. A self-luminous light source comprising:

inner and outer glass tubes of substantially equal length, placed within one another to define an elongated axial space within the inner tube and an elongated annular space between the inner and outer glass tubes;

annular glass end members extending between the inner and outer glass tubes at opposite ends thereof, the end members and coaxial tubes entirely closing the elongated annular space;

a phosphor coating on at least one surface of the inner and outer tubes; and, a radioactive gas disposed in the elongated annular space.

2. The light source of claim 1, wherein the tubes are of circular cross section.

3. The light source of claim 1, further comprising a seal tube for charging the elongated annular space, the seal tube being a hollow tube communicating with the annular space, the seal tube extending from at least one of the end members and operable to complete sealing of the annular space upon melting of the seal tube.

4. A self-luminous light source comprising:

a light-permeable outer shell enclosing a volume;

an inner body disposed within the shell and surrounded by the shell, the body being complementarily shaped to the shell, and smaller than the shell, a space of substantially constant width being thereby bounded by facing surfaces of the shell and the body;

at least one member connecting the shell and body, and rigidly holding the body at said width within the shell, the shell being an elongated tube and the body being an elongated cylinder, the shell and the body being connected by end members at both ends of the tube and the cylinder, the end members closing the space between the tube and the cylinder;

a radioactive gas disposed only in said space; and a phosphor coating on at least one of the surfaces of the shell and body, the phosphor coating being responsive to emissions of the radioactive gas.

5. The light source of claim 4, wherein the shell and body are both light-permeable glass tubes, the tubes being coaxial and said space being an elongated annular space, a central portion being enclosed by an inner one of said glass tubes said inner tube being open at both ends, said end members being annular members closing the annular space at both ends of the glass tubes.

6. The light source of claim 4, further comprising a light-permeable casing enclosing the shell, body, gas and phosphor coating; and, at least one mounting pad extending between the shell and the casing.

7. The light source of claim 6, wherein the mounting pad is a resilient body for absorbing mechanical shocks.

8. The light source of claim 6, further comprising a handle member rigidly attached to the casing.

* * * * *